US005809810A

United States Patent [19]

Enderlin

[11] Patent Number: 5,809,810

[45] Date of Patent: Sep. 22, 1998

[54] HEAD FOR DYE COATING BY DEPOSITION FROM A BATH ON MOVING FILAMENTS

[75] Inventor: Robert Enderlin, Morschwiller-Le-Bas, France

[73] Assignee: Superba (Societe Anonyme a Directoir et Conseil de Surveillance), Mulhouse, France

[21] Appl. No.: 855,698

[22] Filed: May 8, 1997

[30] Foreign Application Priority Data

May 20, 1996 [FR] France ..... 96 06384

[51] Int. Cl.[6] ..... D06B 1/00

[52] U.S. Cl. ..... 68/200; 118/420

[58] Field of Search ..... 68/200, 201, 202; 8/151.2, 155; 118/420, 419; 28/167, 169, 178

[56] References Cited

U.S. PATENT DOCUMENTS

| | | | |
|---|---|---|---|
| 1,575,234 | 3/1926 | Thomayer | 68/200 |
| 1,940,748 | 12/1933 | Gwaltney | 118/420 |
| 3,098,374 | 7/1963 | Langston | 68/200 |
| 4,665,723 | 5/1987 | Zimmer | 68/200 |
| 4,719,771 | 1/1988 | Brough et al. | 68/200 |
| 4,874,390 | 10/1989 | Legault | 8/151.2 |
| 5,195,225 | 3/1993 | Zeiffer et al. | 68/200 |
| 5,501,734 | 3/1996 | Oliphant | 118/420 |
| 5,683,511 | 11/1997 | Kremers et al. | 68/200 |

FOREIGN PATENT DOCUMENTS

| | | | |
|---|---|---|---|
| 2 650 311 | 2/1991 | France . | |
| 62-53468 | 3/1987 | Japan | 68/200 |

*Primary Examiner*—Amy B. Vanatta
*Attorney, Agent, or Firm*—Young & Thompson

[57] ABSTRACT

A dye coating head for depositing dye from a bath onto moving filaments, is in the form of a box having first and second portions (1 and 2) articulately interconnected with an upper portion (1) fixed and a lower portion (2) vertically swingable. A guide (3) for individual filaments of a layer of filaments is mounted on a side of the box which is upstream when seen in the direction movement of the filaments. This guide (3) is transversely displaceable relative to the direction of movement of the filaments. The vertically swingable lower portion (2) has a front wall (7) which, when raised, closes a front portion of the box when the guide (3) is rearwardly moved.

12 Claims, 4 Drawing Sheets

HEAD FOR DYE COATING BY DEPOSITION FROM A BATH ON MOVING FILAMENTS

BACKGROUND OF THE INVENTION

The present application corresponds to French application Ser. No. 96 06384, filed May 20, 1996, the disclosure of which is incorporated herein by reference.

DESCRIPTION OF THE RELATED ART

The present invention relates to the field of the textile industry, in particular the treatment of filaments, especially by dyeing filaments and has for its object a dye coating head for deposit from a bath onto moving filaments.

Textile filaments are usually subjected before use, particularly for weaving, to washing and/or bleaching treatments as well as dyeing.

To this end, the dyeing is particularly carried out wet, by means of machines with one or several coating heads, which are traversed by the filaments of a layer of filaments to be dyed. At the entry to these latter, the filaments must be perfectly maintained and guided, so as to avoid any overlapping prejudicial to good operation, by means of holding and guiding devices consisting generally of combs, and if desired, of fixed supports disposed upstream of each coating head, on the corresponding lateral surface of said coating head.

The coating heads are present in form of boxes enclosing an atomizing device and filament supports, these boxes being provided with a lateral opening for access to said internal device for atomization and filaments supports, closed by means of a removable door, and with an external guide means for the filaments and for support of these latter, generally in form of a comb mounted fixedly in front of a slot for passage of the filament provided in the removable door.

The combs or other supports permit perfect guiding of the filaments at the inlet and in the coating heads, by preventing any erratic displacement of the filaments, such as vibrations occasioning lateral movements of the filaments which can result in undesirable entangling of said filaments.

In known coating heads, the winding up of the layers of filaments to be dyed takes place by means of needles individually connected to each filament and threaded successively into the external guide means, or comb, then into the chamber through the slot in the removable door, the internal support and guidance means and a second outlet slot provided on the surface of the chamber opposite the removable door. However, such a winding up is particularly difficult and becomes punishing when the coating heads are difficult to access, for example when they are mounted in closed chambers.

Moreover, each intervention within the coating heads requires demounting of the removable side door and practically a removal of the filaments, because these latter are removed on a means secured to said door.

SUMMARY OF THE INVENTION

The present invention has for its object to overcome these drawbacks by providing a dye coating head for deposition from a bath onto moving filaments, permitting easy winding of the filaments of a layer of filaments and simplified access to the interior of said coating head.

To this end, the dye coating head by bath deposition on moving filaments is characterized in that it is present in the form of a box in two elements articulated to each other and opening at its front and in that it is provided with guidance and/or support means for the individual filaments of a layer of filaments, mounted on its upstream side surface, as seen in the direction of movement of the filaments, with the possibility of transverse displacement relative to this direction.

BRIEF DESCRIPTION OF THE DRAWINGS

The invention will be better understood from the description which follows, which relates to a preferred embodiment, given by way of nonlimiting example, and explained with reference to the accompanying schematic drawings, in which.

DESCRIPTION OF THE PREFERRED EMBODIMENTS

Figure 1:
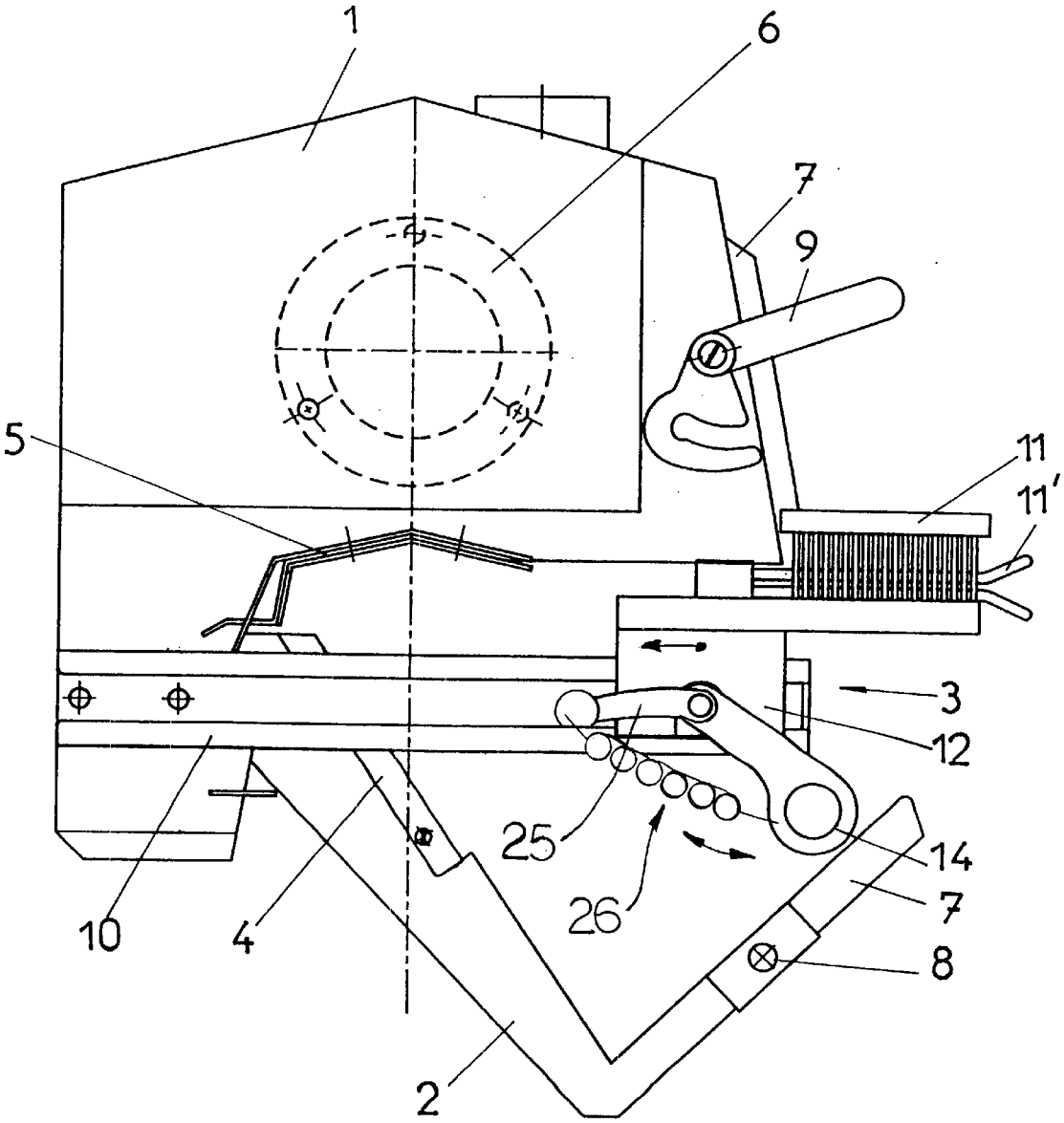
FIG. 1 is a side elevational and cross-sectional view of a dye coating head according to the invention, in operative position.
Figure 2:
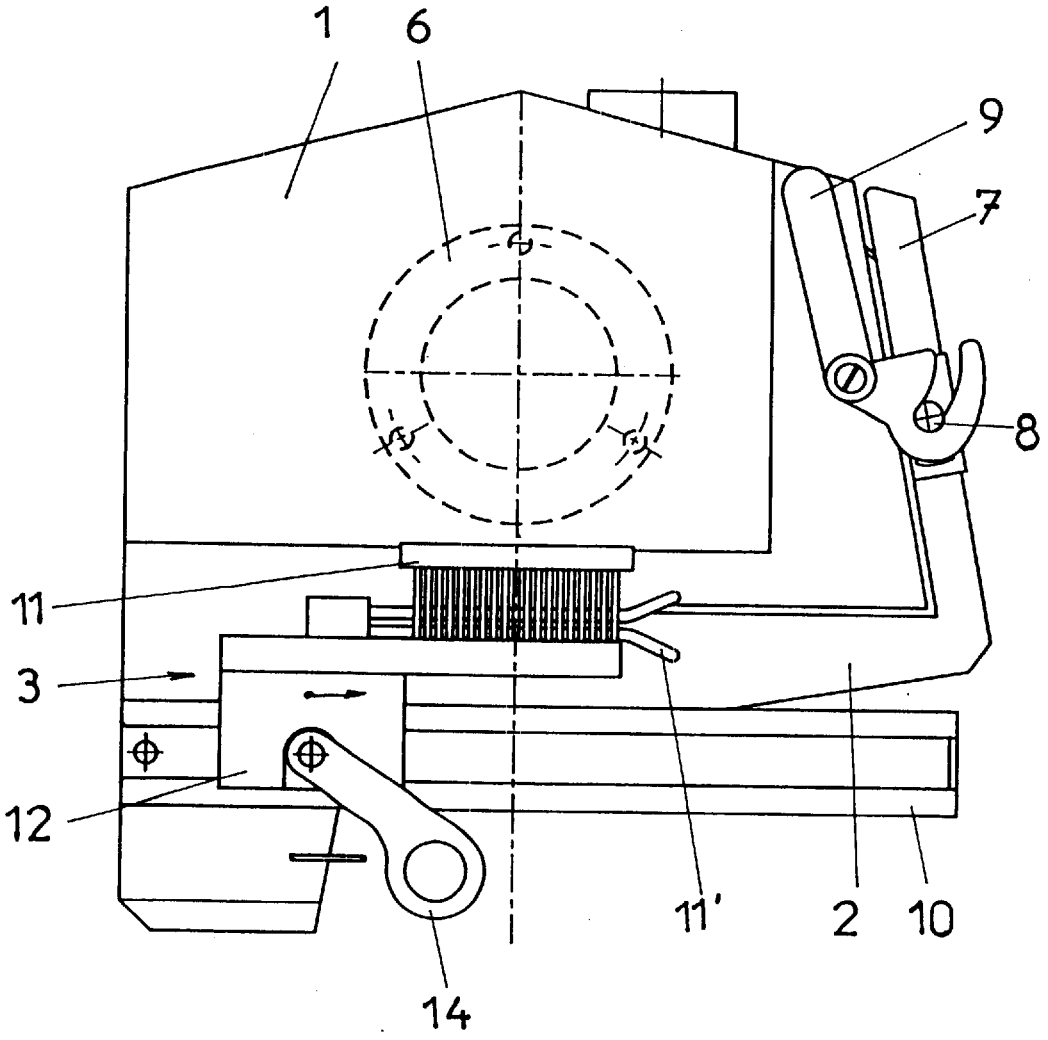
FIG. 2 is a view analogous to that of FIG. 1, the head being in open position and the guidance and/or support means for the filaments being displaced in front of the coating head relative to the operative position.
Figure 3:
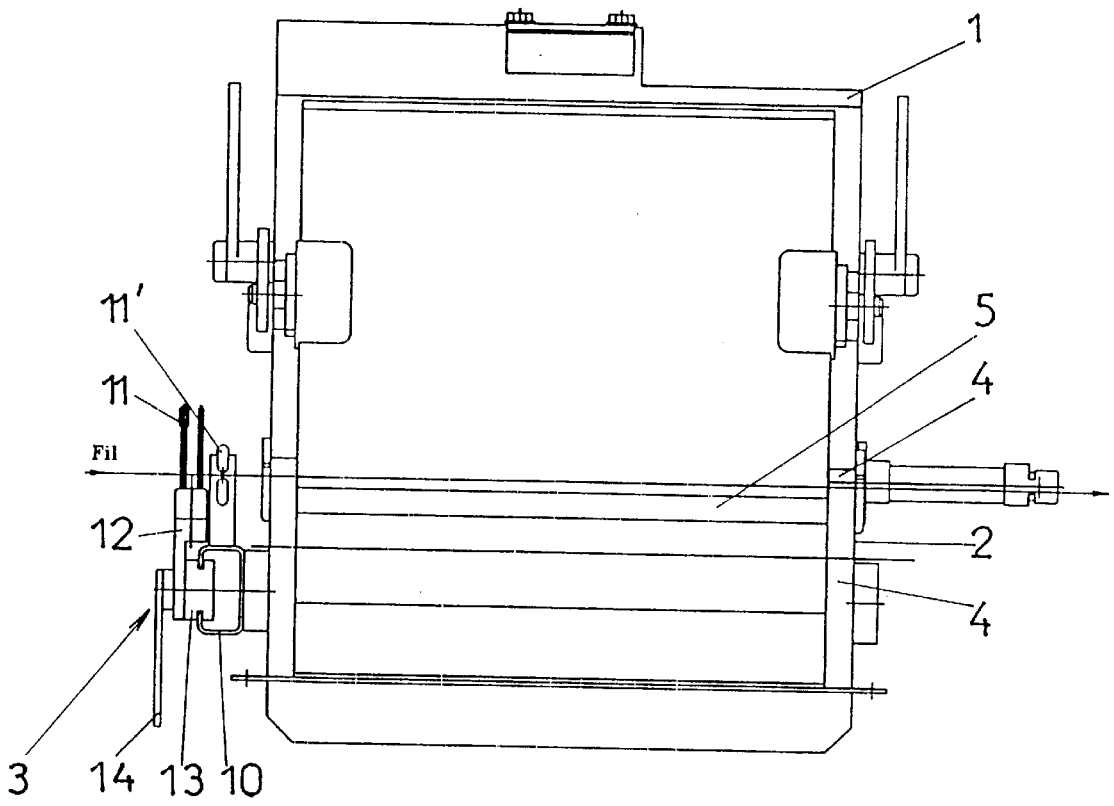
FIG. 3 is a front elevational view of FIG. 2.

According to the invention, and as shown more particularly by way of example in FIGS. 1–3 of the accompanying drawings, the dye coating head for deposit from a bath on moving filaments is in the form of a box in two elements 1 and 2 articulatedly interconnected and opening in the front and is provided with a guidance and/or support means 3 for individual filaments of a layer of filaments, mounted on the upstream lateral side, seen in the direction of movement of the filaments, with the possibility of transverse displacement relative to this direction.

According to one characteristic of the invention, the two elements 1 and 2 forming the box constituting the coating head are articulatedly interconnected adjacent the rear face of said box and have a joint plane of their lateral surfaces situated at the level of the passage of the layer of filaments and delimiting, on each lateral side, a slot for passage of said layer of filaments. This passage slot is provided by means of flat guides 4 provided respectively on the upper element 1 and the lower element 2 and displaced slightly behind the joint plane.

This construction of the coating head in two elements separable by pivoting from each other and opening at the level of the passage the layer of filaments, permits rapid and easy insertion of said layer of filaments into said coating head and particularly into the guides and supports for filaments 5 provided within this box and adapted particularly to maintain said filaments during their dye coating by means of an atomizing head 6 or the like.

Preferably, the lower element 2 is made, as shown in FIG. 1, so as to be pivotable relative to the upper element 1, which is fixed.

According to another characteristic of the invention, the lower element 2 comprises, on its edge opposite the edge of articulation on the upper element 1, a front wall element 7 provided on its lateral sides with lugs or pins 8 adapted to coact with a corresponding closure locking means 9 in the form of a latch or the like, this portion of the front wall 7 extending, in the closed position of the lower element 2, in front the opening of a cross-section slightly less than the front face of the upper element 1. Thus, in the open position of the coating head according to the invention, which is to say when the lower element 2 is in the position shown in FIG. 1 of the accompanying drawings, access to the interior of the head in particular to the spray head 6 and to the filament guide and support 5 and the possible operations of placement and repair, are greatly facilitated.

In shown in FIGS. 1–4 of the accompanying drawing, the means 3 for guidance and/or support of individual filaments of a layer of filaments is mounted on the side surface of the coating head located upstream, seen in the direction of movement of the filaments, by means of a transverse guide device 10 fixed on the upper element 1 of the box constituting said head, and is present in the form of a comb 11 or the like, and if desired, a holding guide 11', secured to a carriage 12 guided displaceably in the transverse guide device 10. This latter is present preferably in the form of a rail coacting with rollers 13 secured to the carriage 12 for supporting the comb 11 and the holding guide 11'. This latter can be present, as shown in the accompanying drawings, in the form of two horizontal bars preventing vertical vibrations of the filaments.

This manner of mounting the comb 11 on the coating head and more particularly on the upper element 1, permits, after opening by pivoting downwardly the lower element 2, easily disengaging a layer of filaments guided by the comb 11 outside the coating head and the filament guide and support 5, for example, for an operation such as knotting a broken filament or else carrying out rapidly a winding of a layer of filaments outside the coating head, the wound layer being then inserted into the head and in particularly into the filament guide and support 5.

For blockage in operating position and if desired in winding outlet position, or another operation, of the guidance and/or support means 3 for a layer of filaments, the carriage 12 for supporting the comb 11 and for the holding guide 11' is preferably provided with position stop means such as a cam or the like acting on the transverse guidance device 10 under the action of a spring (not shown) and whose unlocking is effected by means of manipulating lever 14.

This means of stopping in position is not described in greater detail, but is well known to the art of blocking in position members guided along rails and consists of a cam 25 urged by a spring 26 and mounted on the pivoting axle of the manipulating lever 14, the force of the spring having the effect of blocking said cam against the rail, thereby preventing any displacement and the action of the lever 14 against the action of the spring having the effect of unblocking said cam and permitting displacement of the carriage 12.

According to one embodiment of the invention, the comb 11 and the holding guide 11' can be in the form of fixed elements mounted on the carriage 12, as shown in FIGS. 1–3 of the accompanying drawings.

Figure 4A:
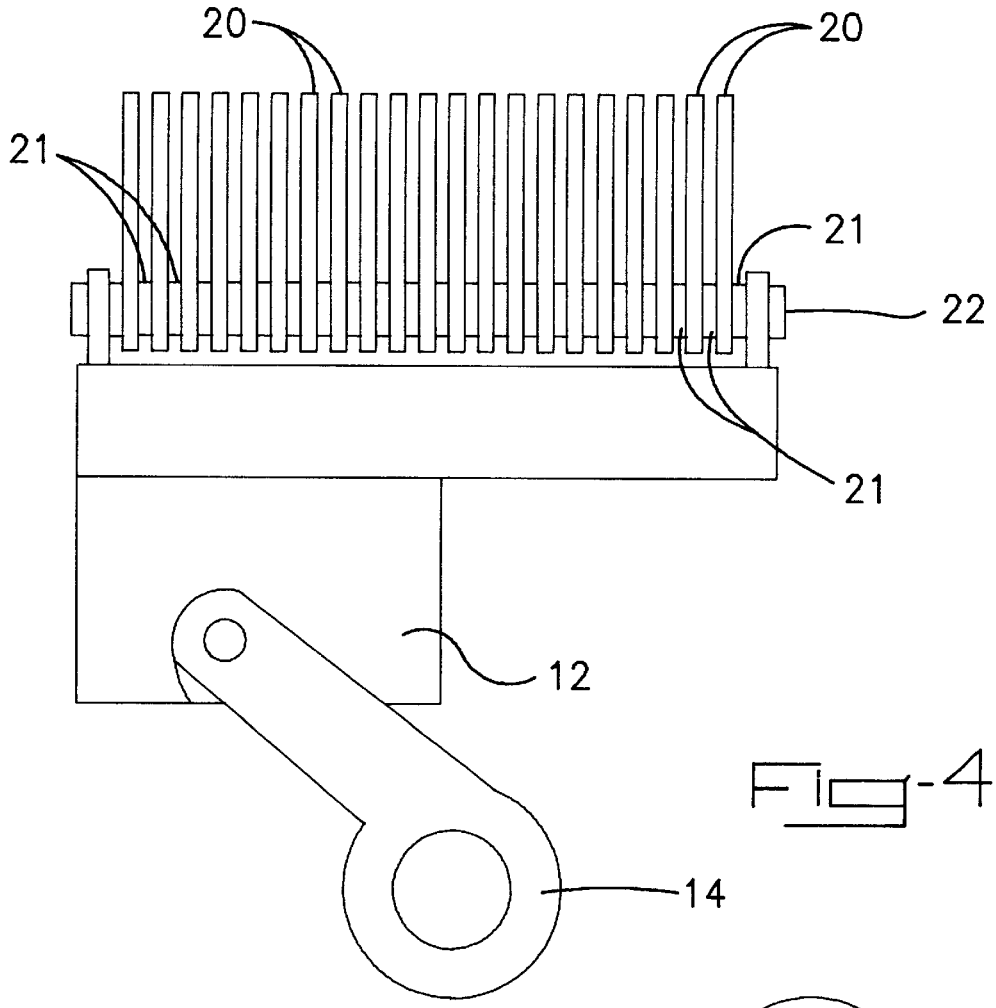
FIGS. 4*a* and 4*b* are views of a rotatable comb mounted on a carriage.
Figure 4B:
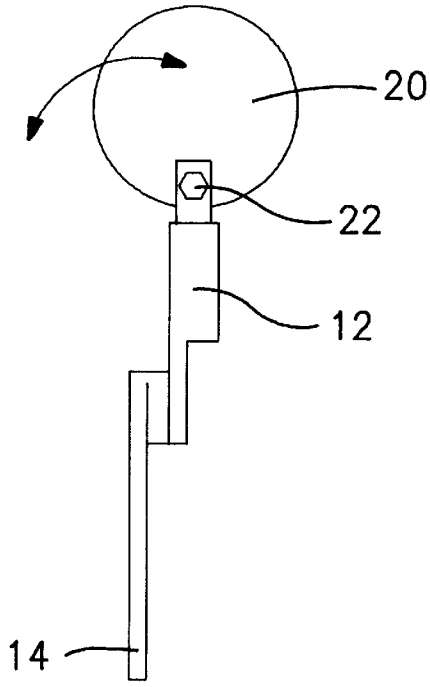

However, with reference to FIGS. 4*a* and 4*b*, according to a modified embodiment of the invention, the comb 11 could also be constituted by means for the guidance and/or support of the individual filaments of a layer of filaments, mounted with the possibility of rotation on the carriage 12.

This means for guidance and/or support of the individual filaments of a layer of filaments can be in the form of a rotatable comb constituted by a stack of disks 20 separated by spacers 21, the assembly being locked on a shouldered shaft 22 by means of a nut and washers. Thus, as a function of the titer or metric numeral of the filaments to be guided, the spacing between the disks and their thickness can be modified, respectively by replacement of the spacers with thicker or thinner spacers and by replacement of the disks by thicker or thinner disks.

Such a mounting of a rotatable comb permits the travelling filament always to carry out a removal of the previous deposits during its passage through said comb, such that this latter becomes self cleaning, which is particularly interesting for working with wet filaments as is the case during dyeing, thereby permitting avoiding agglomeration of a wet wad. As a result, the dangers of filament breakage upon periodic detachment of agglomerated wads, can be largely avoided.

Thanks to the invention, it is possible to provide a dye coating head with deposit from a bath on filaments, permitting facilitated winding of a layer of filaments, even in the case in which the coating head is disposed in a place difficult to access. Moreover, the access to the different devices internal to the head, with a view to replacement or repair, is also facilitated.

Of course, the invention is not limited to the embodiment described and shown in the accompanying drawings. Modifications remain possible, particularly to the construction of the various elements or by substitution of technical equivalents, without thereby departing from the scope of protection of the invention.

What is claimed is:

1. A dye coating head for depositing dye from a bath onto moving filaments, comprising a box having first and second portions (1 and 2) articulately interconnected and provided with guide means (3) for individual filaments of a layer of filaments, said guide means being mounted on an upstream lateral side of said box as seen in the direction of movement of the filaments, said guide means being displaceable transversely relative to said direction of movement of the filaments.

2. Dye coating head according to claim 1, wherein said first and second portions (1 and 2) forming the box are articulately interconnected adjacent a side of the box opposite said guide, said first and second portions having a joint plane located adjacent the level of passage of a layer of filaments, there being on each lateral side of the box a slot for passage of said layer of filaments.

3. Dye coating head according to claim 2, wherein each of said slots comprises flat guides (4) provided respectively on said first portion (1) and said second portion (2) of said box.

4. Dye coating head according to claim 3, wherein said portion (2) is vertically swingable and said first portion (1) is fixed.

5. Dye coating head according to claim 2, wherein said second portion (2) is a lower portion and said first portion (1) is an upper portion, and said lower portion (2) comprises, on a side of said box opposite an axis of articulation of said portions with each other, a front wall (7) provided on its lateral sides with means (8) adapted to coact with a closure locking means (9), said front wall (7) extending in a closed position of said lower portion (2) in front of an opening of a cross-section slightly smaller than the front surface of said upper portion (1).

6. Dye coating head according to claim 1, wherein said guide means (3) is mounted on a lateral surface of the coating head located upstream when viewed in the direction of movement of the filaments, by means of a transverse guide device (10) fixed on an upper portion (1) of the box and comprising a comb (11).

7. Dye coating head according to claim 6, further comprising a holding guide (11') secured to a carriage (12) guided displaceably in the transverse guide device (10).

8. Dye coating head according to claim 7, wherein the transverse guide device (10) comprises a rail coacting with rollers (13) secured to the carriage (12) for supporting the comb (11).

9. Dye coating head according to claim 8, wherein the carriage (12) comprises a manipulable lever and a position stop means that can be freed by means of a manipulable lever (14).

10. Dye coating head according to claim 7, wherein the comb (11) and the holding guide (11') comprises elements fixedly mounted on the carriage (12).

11. Dye coating head according to claim 7, wherein the comb (11) is mounted for rotation on the carriage (12).

12. Dye coating head according to claim 6, wherein the comb (11) comprise a stack of disks separated by spacers.

* * * * *